US008902263B2

(12) United States Patent
Ryu et al.

(10) Patent No.: US 8,902,263 B2
(45) Date of Patent: Dec. 2, 2014

(54) DISPLAY DEVICE AND DRIVING METHOD THEREOF

(75) Inventors: Jae-Woo Ryu, Yongin (KR); Do-Ik Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 464 days.

(21) Appl. No.: 13/067,480

(22) Filed: Jun. 3, 2011

(65) Prior Publication Data

US 2012/0056916 A1 Mar. 8, 2012

(30) Foreign Application Priority Data

Sep. 2, 2010 (KR) ..... 10-2010-0085992

(51) Int. Cl.
*G09G 5/10* (2006.01)
*G09G 3/32* (2006.01)

(52) U.S. Cl.
CPC ..... *G09G 5/10* (2013.01); *G09G 3/3208* (2013.01)
USPC ..... 345/691; 345/690

(58) Field of Classification Search
CPC ..... G09G 2320/029; G09G 2320/043; G09G 2300/43; G09G 2320/0295
USPC ..... 345/76–86, 204
See application file for complete search history.

(56) References Cited

U.S. PATENT DOCUMENTS

| | | | | |
|---|---|---|---|---|
| 2005/0280766 | A1* | 12/2005 | Johnson et al. | 349/167 |
| 2007/0080905 | A1* | 4/2007 | Takahara | 345/76 |
| 2007/0085798 | A1* | 4/2007 | Hashimoto et al. | 345/93 |
| 2007/0234152 | A1* | 10/2007 | Kwon et al. | 714/726 |
| 2008/0084411 | A1* | 4/2008 | Oomori et al. | 345/211 |
| 2008/0210847 | A1* | 9/2008 | Hente et al. | 250/205 |
| 2009/0140956 | A1* | 6/2009 | Choi | 345/76 |
| 2009/0206339 | A1* | 8/2009 | Park et al. | 257/59 |
| 2011/0074750 | A1* | 3/2011 | Leon et al. | 345/207 |

FOREIGN PATENT DOCUMENTS

| | | | |
|---|---|---|---|
| JP | 2007-206464 | A | 8/2007 |
| KR | 10-2002-0063524 | A | 8/2002 |
| KR | 10-2007-0048525 | A | 5/2007 |
| KR | 10-2010-0012247 | A | 2/2010 |

* cited by examiner

*Primary Examiner* — Viet Pham
(74) *Attorney, Agent, or Firm* — Lee & Morse, P.C.

(57) ABSTRACT

A display device includes: a display unit including a plurality of pixels connected to a plurality of scan lines and a plurality of data lines and emitting light according to corresponding image data; a dummy pixel connected to a dummy scan line and a dummy data line; and a compensation image data generator calculating a compensation amount according to an accumulation light emitting time of the first organic light emitting element to detect the compensation amount corresponding to each accumulation light emitting time of a plurality of second organic light emitting elements of the plurality of pixels by using a decreasing amount of luminance corresponding a resistance of a first organic light emitting element according to an accumulation light emitting time of the first organic light emitting element of the dummy pixel, and compensating the corresponding image data according to the detected compensation amount.

16 Claims, 3 Drawing Sheets

DISPLAY DEVICE AND DRIVING METHOD THEREOF

BACKGROUND

1. Field

Embodiments relate to a display device and a driving method thereof. More particularly, embodiments relate to an organic light emitting diode (OLED) display and a driving method thereof.

2. Description of the Related Art

A display device has a display area in which a plurality of pixels are disposed on a substrate in a matrix form. The display device performs a display operation by selectively applying a data signal to a pixel connected to a scan line and a data line. The display device is classified into a passive matrix light emitting display device and an active matrix light emitting display device according to a driving scheme of the pixels. The active matrix light emitting display device, in which unit pixels are selectively lit, is primarily used because of its enhanced resolution, contrast, and operation speed.

The display device is used for portable information terminals, such as personal computers, mobile phones, PDAs, as well as monitors for various information equipment. Currently, an LCD using a liquid crystal panel, an organic light emitting diode display using an organic light emitting diode, a PDP using a plasma panel, etc., are known in the field. In recent years, various light emitting display devices having less weight and volume than a cathode ray tube have been developed. In particular, an organic light emitting diode display having excellent emission efficiency, luminance, viewing angles, and rapid response speed has attracted public attention.

However, as the usage time of the organic light emitting element is increased, the luminance is deteriorated. This deterioration results in image degradation, e.g. image sticking. Conventionally, a photosensor sensing the luminance of the organic light emitting element is provided. When the luminance is decreased, the decreased luminance is compensated. However, problems such as an increase of material cost, difficulty of coupling and decoupling thereof, and measuring error according to the usage of the photosensor are generated.

The above disclosed information is only for understanding the background of the invention. Therefore, it may contain information that does not form the prior art that is already known in this country to a person of ordinary skill in the art.

SUMMARY

Embodiments are therefore directed to a display device, which substantially overcome one or more of the problems due to the limitations and disadvantages of the related art.

It is therefore a feature of an embodiment to provide a display device capable of preventing image sticking due to luminance deterioration without an additional photosensor.

It is therefore another feature of an embodiment to provide a method for driving a display device capable of preventing image sticking due to luminance deterioration without an additional photosensor.

At least one of the above and other features and advantages may be realized by providing a display device including a display unit including a plurality of pixels connected to a plurality of scan lines and a plurality of data lines, the plurality of pixels emitting light according to corresponding image data; a dummy pixel connected to a dummy scan line and a dummy data line, the dummy line including a first organic light emitting element and each pixel including a second organic light emitting element; and a compensation image data generator configured to: calculate a compensation amount according to an accumulation light emitting time of a first organic light emitting element; detect the compensation amount corresponding to each accumulation light emitting time of the plurality of second organic light emitting elements using a decreasing amount of luminance corresponding to a resistance of the first organic light emitting element according to an accumulation light emitting time of the first organic light emitting element of the dummy pixel; and compensate the corresponding image data according to the detected compensation amount. The compensation image data generator may be configured to sense resistance of the first organic light emitting element according to a sensing voltage generated to both terminals of the first organic light emitting element when a predetermined current flows in the first organic light emitting element.

The compensation image data generator may include: a memory storing the decreasing amount of luminance of the first organic light emitting element corresponding to the sensing voltage; a timer measuring the accumulation light emitting time of the first organic light emitting element; a data sum unit accumulating and summing the image data respectively corresponding to the plurality of pixels per each pixel; a compensation amount calculator calculating the compensation amount of the corresponding image data according to the accumulation light emitting time by using the resistance of the first organic light emitting element and the accumulation light emitting time; and an image data compensator sensing each accumulation light emitting time of the plurality of second organic light emitting elements and modulating the corresponding image data into the compensation amount corresponding to the accumulation light emitting time.

The compensation amount calculator may detect the decreasing amount of luminance corresponding to the sensing voltage and may calculate the increasing amount of the accumulation light emitting time corresponding to the detected decreasing amount of luminance as the compensation amount. The display device may further include a lookup table storing the compensation amount time calculated from the compensation amount calculator according to the accumulation light emitting time. The image data compensator may modulate the corresponding image data for the predetermined compensation unit time. The dummy pixel may receive a dummy data voltage corresponding to a full white grayscale through the dummy data line.

At least one of the above and other features and advantages may also be realized by providing a method for driving a display device including a dummy pixel including a first organic light emitting element and a plurality of pixels respectively including a second organic light emitting element. The method includes: calculating a compensation amount according to an accumulation light emitting time of the first organic light emitting element by using a decreasing amount of luminance corresponding to resistance of a first organic light emitting element according to the accumulation light emitting time of the first organic light emitting element; determining a compensation amount corresponding to the accumulation light emitting time of each second organic light emitting element; and compensating the image data respectively corresponding to the plurality of pixels according to the calculated compensation amount.

Calculating the compensation amount may include: detecting the sensing voltage between both terminals of the first organic light emitting element when a predetermined current flows to the first organic light emitting element; measuring the accumulation light emitting time of the first organic light emitting element; and calculating the increasing amount of the light emitting time of the first organic light emitting element corresponding to the decreasing amount of the luminance by using the decreasing amount of luminance of the first organic light emitting element corresponding to the sensing voltage. Compensating the image data may be executed every predetermined compensation unit time. The method may further include applying a dummy data voltage corresponding to a full white grayscale to the dummy pixel.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Korean Patent Application No. 10-2010-0085992, filed on Sep. 2, 2010, in the Korean Intellectual Property Office, and entitled: "Display Device and Driving Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 1:
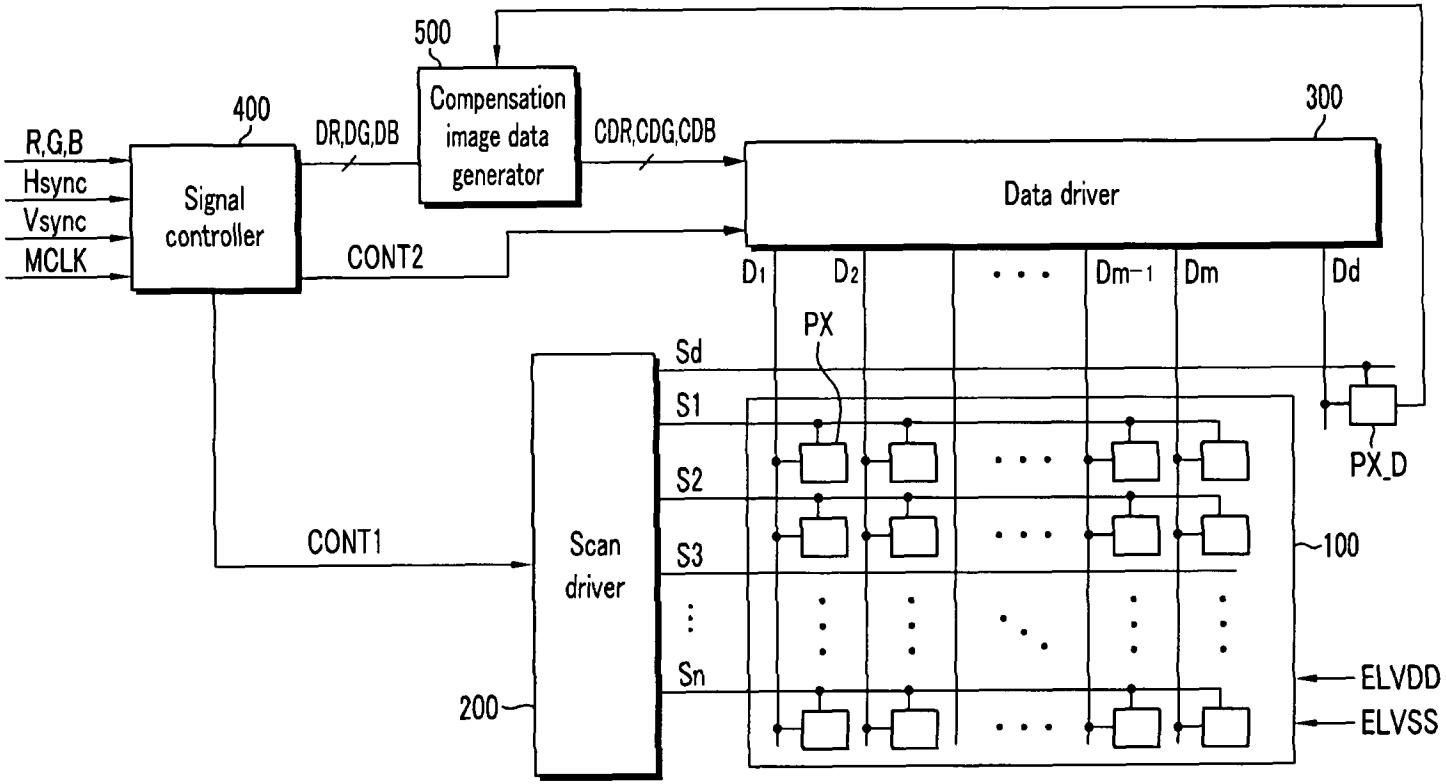
FIG. 1 illustrates a block diagram of a display device according to an exemplary embodiment.
Figure 2:
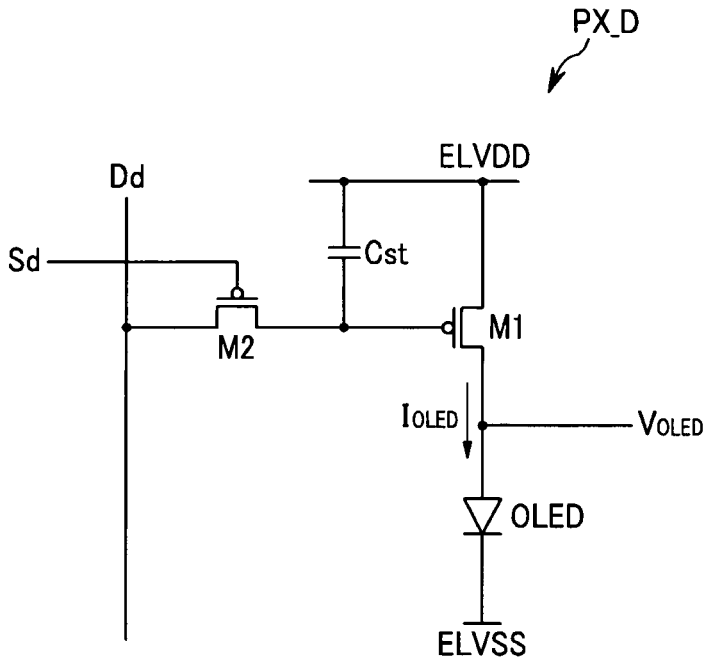
FIG. 2 illustrates an equivalent circuit diagram of a dummy pixel PX_D shown in FIG. 1.

FIG. 1 illustrates a block diagram of a display device according to an exemplary embodiment. FIG. 2 is an equivalent circuit diagram of a dummy pixel PX_D shown in FIG. 1.

Referring to FIG. 1, a display device according to the present embodiment includes a display unit 100, a dummy pixel PX_D, a scan driver 200, a data driver 300, a signal controller 400, and a compensation image data generator 500. The display unit 100 may include a plurality of signal lines S1-Sn and D1-Dm, a plurality of pixels PX connected thereto, and arranged in a matrix format.

The signal lines S1-Sn and D1-Dm includes a plurality of scan lines S1-Sn transmitting scan signals and a plurality of data lines D1-Dm transmitting data signals. The scan lines S1-Sn may be arranged in parallel along a row direction. The data lines D1-Dm may be arranged in parallel along a column direction intersecting the scan lines S1-Sn.

Also, a dummy pixel PX_D may be connected to a dummy scan line SD and a dummy data line Dd. The dummy pixel PX_D may be separately formed outside the display unit 100 when forming the plurality of pixels PX of the display unit 100. The dummy pixel PX_D may have the same characteristics as the plurality of pixels PX of the display unit 100.

Referring to FIG. 2, the dummy pixel PX_D includes an organic light emitting element, a driving transistor M1, a capacitor Cst, and a switching transistor M2.

The driving transistor M1 has a source terminal receiving the first driving voltage ELVDd and a drain terminal connected to an anode terminal of the organic light emitting element. A gate terminal of the driving transistor M1 is connected to the drain terminal of the switching transistor M2. The driving transistor M1 allows a driving current $I_{OLED}$, of which magnitude varies depending on a voltage applied between the gate terminal and the source terminal, to flow to the organic light emitting diode (OLED).

The switching transistor M2 has a gate terminal connected to the dummy scan line SD and a source terminal connected to the dummy data line Dd. The switching transistor M2 performs the switching operation in response to the scan signal applied to the dummy scan line SD. When the switching transistor M2 is turned on, the data signal applied to the dummy data line Dd, i.e., the data voltage, is transmitted to the gate terminal of the driving transistor M1.

The capacitor Cst is connected between the source terminal and the gate terminal of the driving transistor M1. The capacitor Cst is charged by the data voltage applied to the gate terminal of the driving transistor M1, and maintains the voltage even after the switching transistor M2 is turned off.

The organic light emitting element may be realized by an organic light emitting diode (OLED). The organic light emitting element has the cathode terminal receiving the second driving voltage ELVSS. The organic light emitting element displays an image by emitting light with different intensities according to a current $I_{OLED}$ that is supplied by the driving transistor M1. Generally, the organic light emitting element deteriorates over driving time such that the resistance thereof is increased. When the resistance is increased, the amount of light emitted is decreased for the same current. The decrease in amount of light emitted occurs according to the deterioration degree.

The luminance is used as a factor representing the light emitting amount of the organic light emitting element. The resistance of the organic light emitting element is increased according to the deterioration of the organic light emitting element. Thus, the luminance for the same current is decreased. The resistance of the organic light emitting element is increased such that the sensing voltage $V_{OLED}$ between the anode terminal and the cathode terminal is increased. The $V_{OLED}$ between the anode terminal and the cathode terminal is generated when the driving current $I_{OLED}$ flows in the organic light emitting element.

The organic light emitting diode (OLED) display of an exemplary embodiment determines the deterioration degree of the organic light emitting element according to the driving time by using the sensing voltage $V_{OLED}$ of the dummy pixel PX_D. The organic light emitting diode (OLED) display compensates the size of the driving current $I_{OLED}$, flowing in the organic light emitting element according to image data DR, DG, and DB, by the deterioration degree in an analog driving method.

The organic light emitting diode (OLED) display compensates the light emitting time of the organic light emitting element, according to the image data DR, DG, and DB, by the deterioration degree in a digital driving method. Thus, the organic light emitting diode (OLED) display may compensate the luminance decreasing according to the deterioration of the organic light emitting element. The organic light emitting diode (OLED) display according to the present embodiment uses the image data DR, DG, and DB corresponding to the plurality of pixels PX to determine the deterioration degree of each organic light emitting element of the plurality of pixels PX. The detailed description will be described below with reference to FIG. 3.

Although the driving transistor M1 and the switching transistor M2 are shown as p-channel field effect transistors (FETs) in FIG. 2, the embodiment is not limited thereto. For example, at least one of the driving transistor M1 and the switching transistor M2 may be an n-channel field effect transistor. Furthermore, the connection relationship of the driving transistor M1, the switching transistor M2, the capacitor Cst, and the organic light emitting diode (OLED) may be changed. The dummy pixel PX_D shown in FIG. 2 is one example of one pixel of the display device. Thus, pixels of different types, including at least two transistors and at least one capacitor, may be used. The configuration of the pixel PX shown in FIG. 1 is the same as that of the dummy pixel PX_D shown in FIG. 2. Therefore, the description thereof is omitted.

Referring back to FIG. 1, the scan driver 200 is connected to the scan line S1 to Sn of the display unit 100, and sequentially applies the scan signals S1 to Sn in accordance with a scan control signal CONT1. The scan signal includes a gate-on voltage Von that can turn on the switching transistor M2 and a gate-off voltage Voff that can turn off the switching transistor M2. When the switching transistor M2 is the p-channel field effect transistor, the gate-on voltage Von and the gate-off voltage Voff are a low voltage and a high voltage, respectively.

Also, the scan driver 200, according to an exemplary embodiment, is connected to a dummy scan line SD. The scan driver 200 applies the dummy scan signal to the dummy scan line SD. The dummy scan signal applied to the dummy scan line SD maintains the gate-on voltage Von.

The data driver 300 is connected to the data lines D1 to Dm of the display unit 100, and converts compensation image data CDR, CDG, and CDB input from the signal controller 400 into data voltages and applies them to the data lines D1 to Dm in accordance with a data control signal CONT2. The data driver 300 according to an exemplary embodiment is driven by the digital driving method. The data driver 300 controls the pulse width of the data voltage to represent the grayscale of the compensation image data CDR, CDG, and CDB.

The data driver 300 is connected to the dummy data line Dd of the dummy pixel PX_D. The data driver 300 applies the dummy data voltage having the pulse width corresponding to a full white grayscale to the dummy data line Dd.

The signal controller 400 receives input signals R, G, and B, a horizontal synchronization signal Hsync, a vertical synchronization signal Vsync, and a main clock signal MCLK from the outside to generate the image data DR, DG, and DB, the scan control signal CONT1, and the data control signal CONT2

The scan control signal CONT1 includes a scan start signal STV directing scan starting and at least one clock signal for controlling an output cycle of the gate-on voltage Von. The scan control signal CONT1 may include an output enable signal OE defining a running time of the gate-on voltage Von.

The data control signal CONT2 includes a horizontal synchronization start signal STH indicating a transmission start of the compensation image data CDR, CDG, and CDB for the pixel PX of one row to the data driver 300 and a load signal LOAD indicating application of the plurality of data voltage to the data lines D1 to Dm.

The compensation image data generator 500 calculates the compensation amount according to the accumulation light emitting time of the organic light emitting element by using the resistance and the accumulation light emitting time of the organic light emitting element of the dummy pixel PX_D, determines the compensation amount according to each accumulation light emitting time of the organic light emitting element of the plurality of pixels PX, and compensates the image data DR, DG, and DB corresponding each pixel PX according to the determined compensation amount. The image data signals DR, DG, and DB compensated in the compensation image data generator 500 are referred to as compensation image data CDR, CDG, and CDB.

The compensation image data generator 500 according to an exemplary embodiment senses the resistance every time the accumulation light emitting of the organic light emitting element of the dummy pixel is increased by a predetermined compensation unit time. The compensation image data generator 500 determines the compensation amount corresponding to every time that the accumulation light emitting is increased by a predetermined compensation unit time.

Figure 3:
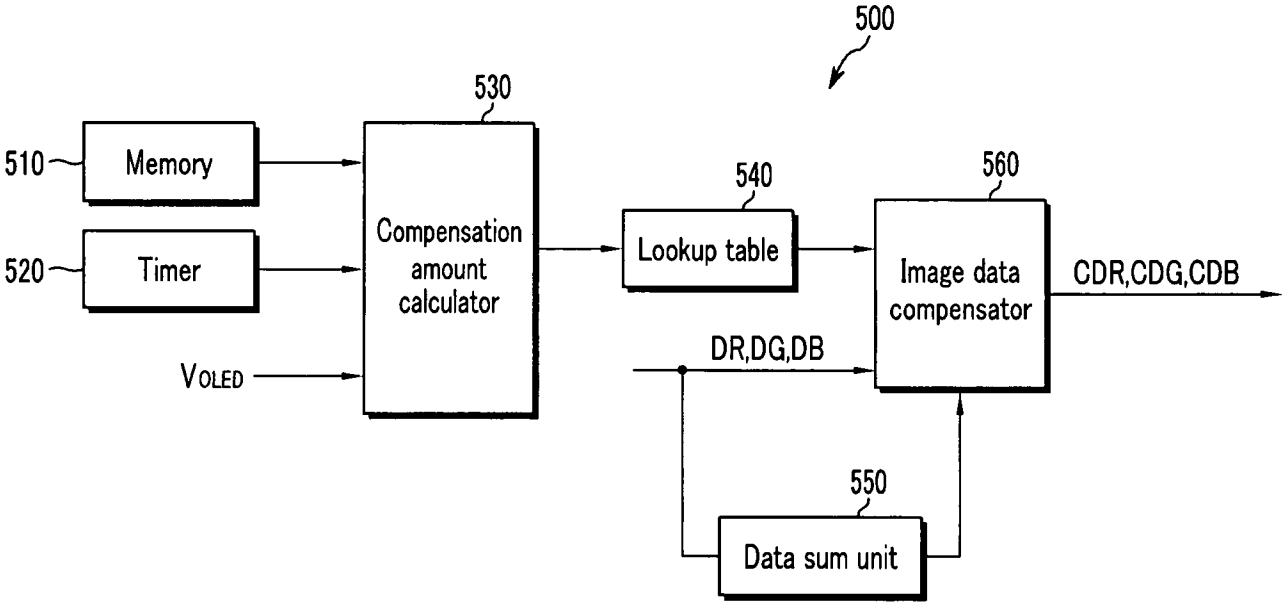
FIG. 3 illustrates a detailed block diagram of a compensation image data generator 500 shown in FIG. 1.

The compensation image data generator 500, as illustrated in FIG. 3, includes a memory 510, a timer 520, a compensation amount calculator 530, a lookup table 540, a data sum unit 550, and an image data compensator 560. The memory 510 stores the decreasing amount of the luminance of the organic light emitting element corresponding to the sensing voltage $V_{OLED}$. The decreasing amount of luminance is the degree that the luminance is decreased compared with the initial predetermined luminance. The luminance occurs when the predetermined driving current $I_{OLED}$ flows in the organic light emitting element.

An exemplary embodiment is operated according to the digital driving method, and the magnitude of the driving current $I_{OLED}$ flowing in the plurality of pixels PX is the same regardless of the image data DR, DG, and DB. The timer 520 measures the accumulation light emitting time of the organic light emitting element of the dummy pixel PX_D and transmits it to the compensation amount calculator 530.

The compensation amount calculator 530 calculates the compensation amount of the image data DR, DG, and DB according to the accumulation light emitting time of the organic light emitting element by using the resistance of the organic light emitting element of the dummy pixel PX_D and the accumulation light emitting time. The compensation amount calculator 530 stores the calculated compensation amount in the lookup table 540 according to the accumulation light emitting time. The compensation amount calculator 530 receives the sensing voltage $V_{OLED}$, and detects the decreasing amount of the luminance corresponding to the input sensing voltage $V_{OLED}$ from the memory 510.

The compensation amount calculator 530 calculates the increasing amount of the accumulation light emitting time of the organic light emitting element to change it into the compensation amount. The compensation amount will compensate the decreasing amount of luminance of the organic light emitting element. The relationship between the increasing amount of the accumulation light emitting time of the organic light emitting element and the decreasing amount of the luminance of the organic light emitting element may be represented by a function F(t). The function F(t) is based on experimental data.

In an exemplary embodiment, the function F(t) represents the increasing amount of the pulse width of the data voltage corresponding to the image data DR, DG, and DB to compensate the decreasing amount of the luminance according to the accumulation light emitting time. The increasing amount of the application time of the data voltage to the decreasing amount of the luminance may have a proportional relationship. The light emitting time of the organic light emitting element may be 20 hours. Therefore, the function F(t), when the decreasing amount of the luminance is 0.1%, increases the application time of the data voltage corresponding to the image data DR, DG, and DB by 0.1%. Thus, the function F(t) calculates the application time of the data voltage. The data voltage is the compensation amount to be maintained for the luminance corresponding to the predetermined grayscale of the image data DR, DG, and DB.

The data sum unit 550 receives the image data DR, DG, and DB. The data sum unit 550 accumulates and sums each image data DR, DG, and DB of the plurality of pixels PX for each pixel PX. The image data DR, DG, and DB accumulated and summed for each pixel PX is the information corresponding to the accumulation light emitting time of each pixel PX. The data sum unit 550 generates the information for the accumulation light emitting time corresponding to the accumulated and summed image data DR, DG, and DB of the plurality of pixel PX.

The image data compensator 560 senses each accumulation light emitting time of the organic light emitting element of the plurality of pixels PX to detect the compensation amount from the lookup table 540 according to the accumulation light emitting time. The image data compensator 560 modulates the image data DR, DG, and DB according to the detected compensation amount. The image data compensator 560 detects the compensation amount every time that the compensation unit time is passed to modulate the image data DR, DG, and DB. The image data compensator 560, according to an exemplary embodiment, generates the compensation image data CDR, CDG, and CDB by using Equation 1 below:

$$DATA_{PWC}=DATA_{PW}*F(t)*p$$

In the above Equation 1, $DATA_{PWC}$ represents the pulse width of the data voltage corresponding to the compensation image data CDR, CDG, and CDB, i.e., the application time of the data voltage. $DATA_{PW}$ represents the application of the data voltage corresponding to the image data DR, DG, and DB. A factor p represents the predetermined initial luminance value.

In an exemplary embodiment, there is an upward normalization method and a downward normalization method for compensating the image data DG, DB, and DR. The upward normalization method is a method determining the factor p as a predetermined value, for example "0.7", and increasing the luminance of each pixel PX to "1". The downward normalization method is a method determining the factor P as "1", and decreasing the luminance of the neighboring pixel PX corresponding to the pixel PX having deteriorated luminance. In the case of the downward normalization method, the function F(t) represents the decreasing amount of the pulse width of the data voltage corresponding to the image data DR, DG, and DB. The decreasing amount of the pulse width of the data voltage will compensate the decreasing amount of luminance according to the total light emitting time. As a result, the image data compensator 560 controls the entire luminance of the display unit 100 to be constant. Thus, image sticking may be prevented.

By way of summation and review, according to embodiments described above, the display device may be capable of preventing image sticking due to luminance deterioration without employing an additional photosensor.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A display device comprising:

a display unit including a plurality of pixels connected to a plurality of scan lines and a plurality of data lines, the plurality of pixels emitting light according to corresponding image data;

a dummy pixel connected to a dummy scan line and a dummy data line, the dummy pixel including a first organic light emitting element and each pixel including a second organic light emitting element; and a compensation image data generator configured to:

calculate a compensation amount according to an accumulation light emitting time of the first organic light emitting element;

detect the compensation amount corresponding to each accumulation light emitting time of the plurality of second organic light emitting elements using a decreasing amount of luminance corresponding to a change in resistance of the first organic light emitting element according to an accumulation light emitting time of the first organic light emitting element of the dummy pixel; and changing a pulse width of the corresponding image data according to the detected compensation amount, wherein the pulse width of the corresponding image data is changed based on the decreasing amount of luminance.

2. The display device as claimed in claim 1, wherein:

the compensation image data generator configured to sense resistance of the first organic light emitting element according to a sensing voltage generated to both terminals of the first organic light emitting element when a predetermined current flows in the first organic light emitting element.

3. The display device as claimed in claim 2, wherein the compensation image data generator includes:

a memory storing the decreasing amount of luminance of the first organic light emitting element corresponding to the sensing voltage;

a timer measuring the accumulation light emitting time of the first organic light emitting element;

a data sum unit accumulating and summing the image data respectively corresponding to the plurality of pixels per each pixel;

a compensation amount calculator calculating the compensation amount of the corresponding image data according to the accumulation light emitting time by using the resistance of the first organic light emitting element and the accumulation light emitting time; and an image data compensator sensing each accumulation light emitting time of the plurality of second organic light emitting elements and modulating the corresponding image data into the compensation amount corresponding to the accumulation light emitting time.

4. The display device as claimed in claim 3, wherein the compensation amount calculator detects the decreasing amount of luminance corresponding to the sensing voltage and calculates the increasing amount of the accumulation light emitting time corresponding to the detected decreasing amount of luminance as the compensation amount.

5. The display device as claimed in claim 3, further comprising:

a lookup table storing the compensation amount time calculated from the compensation amount calculator according to the accumulation light emitting time.

6. The display device as claimed in claim 3, wherein:

the image data compensator modulates the corresponding image data for the predetermined compensation unit time.

7. The display device as claimed in claim 1, wherein:

the dummy pixel receives a dummy data voltage corresponding to a full white grayscale through the dummy data line.

8. A method for driving a display device including a dummy pixel including a first organic light emitting element and a plurality of pixels respectively including a second organic light emitting element, the method comprising:

calculating a compensation amount according to an accumulation light emitting time of the first organic light emitting element by using a decreasing amount of luminance corresponding to a change in resistance of the first organic light emitting element according to the accumulation light emitting time of the first organic light emitting element;

determining a compensation amount corresponding to the accumulation light emitting time of each second organic light emitting element; and changing a pulse width of the image data respectively corresponding to the plurality of pixels according to the calculated compensation amount, wherein the pulse width of the corresponding image data is changed based on the decreasing amount of luminance.

9. The method as claimed in claim 8, wherein calculating the compensation amount includes:

detecting the sensing voltage between both terminals of the first organic light emitting element when a predetermined current flows to the first organic light emitting element;

measuring the accumulation light emitting time of the first organic light emitting element; and calculating the increasing amount of the light emitting time of the first organic light emitting element corresponding to the decreasing amount of the luminance by using the decreasing amount of luminance of the first organic light emitting element corresponding to the sensing voltage.

10. The method as claimed in claim 8, wherein: compensating the image data is executed every predetermined compensation unit time.

11. The method as claimed in claim 8, further comprising:

applying a dummy data voltage corresponding to a full white grayscale to the dummy pixel.

12. A display panel, comprising:

a plurality of first pixels in a display area;

at least one dummy pixel in a non-display area;

a driver coupled to the first pixels and the dummy pixel; and a compensator within or coupled to the driver, wherein the compensator changes a pulse width of image data based on a change in resistance of the organic light emitting device in the dummy pixel, and wherein the driver adjusts driving signals to the first pixels based on the changed image data, wherein the pulse width of the image data is changed based on a decreasing amount of luminance.

13. The display device as claimed in claim 2, wherein the compensation image data generator includes a memory storing the decreasing amount of luminance of the first organic light emitting element corresponding to the sensing voltage.

14. The display device as claimed in claim 13, wherein the compensation image data generator includes:

a timer measuring the accumulation light emitting time of the first organic light emitting element.

15. The display device as claimed in claim 14, wherein the compensation image data generator includes:

a data sum unit accumulating and summing the image data respectively corresponding to the plurality of pixels per each pixel; and a compensation amount calculator calculating the compensation amount of the corresponding image data according to the accumulation light emitting time based on the resistance of the first organic light emitting element and the accumulation light emitting time.

16. The display device as claimed in claim 15, wherein the compensation image data generator includes an image data compensator sensing each accumulation light emitting time of the plurality of second organic light emitting elements and modulating the corresponding image data into the compensation amount corresponding to the accumulation light emitting time.

* * * * *